US010942007B1

(12) United States Patent
Partney

(10) Patent No.: US 10,942,007 B1
(45) Date of Patent: Mar. 9, 2021

(54) APPARATUS TO INTEGRATE BALLISTICS INFORMATION WITH A RIFLE

(71) Applicant: Blake Partney, LaGrande, OR (US)

(72) Inventor: Blake Partney, LaGrande, OR (US)

(73) Assignee: Blake Partney, La Grande, OR (US)

( * ) Notice: Subject to any disclaimer, the term of this patent is extended or adjusted under 35 U.S.C. 154(b) by 0 days.

(21) Appl. No.: 16/737,221

(22) Filed: Jan. 8, 2020

(51) Int. Cl.

| | |
|---|---|
| ***F41G 3/06*** | (2006.01) |
| ***F41G 3/08*** | (2006.01) |
| ***F41G 11/00*** | (2006.01) |
| ***F41G 3/16*** | (2006.01) |
| ***F41G 3/32*** | (2006.01) |

(52) U.S. Cl.
CPC ..... *F41G 3/06* (2013.01); *F41G 3/08* (2013.01); *F41G 3/165* (2013.01); *F41G 11/00* (2013.01); *F41G 3/32* (2013.01)

(58) Field of Classification Search
CPC ... F41G 3/06; F41G 3/08; F41G 3/165; F41G 3/35; F41G 11/00
See application file for complete search history.

(56) References Cited

U.S. PATENT DOCUMENTS

| | | | | |
|---|---|---|---|---|
| 5,546,691 | A * | 8/1996 | Allison | F41C 27/00 42/111 |
| 2003/0010190 | A1* | 1/2003 | Sammut | G02B 27/32 89/41.17 |
| 2011/0168777 | A1* | 7/2011 | Bay | F41G 3/08 235/414 |
| 2012/0131810 | A1* | 5/2012 | Hunsberger | G01B 3/1005 33/767 |
| 2016/0025454 | A1* | 1/2016 | Meinert | F41G 1/387 42/71.01 |

* cited by examiner

*Primary Examiner* — Laura A Gudorf
(74) *Attorney, Agent, or Firm* — Compass IP Law PC

(57) ABSTRACT

An apparatus is described. The apparatus includes a clamp element to clamp to a rifle scope. The apparatus also includes a housing. The housing is mechanically coupled to the clamp element. The housing contains recorded ballistics information.

12 Claims, 6 Drawing Sheets

| Range | Elevation |
|---|---|
| 1000 | 25.25 |
| 900 | 21.25 |
| 800 | 17.50 |
| 700 | 14.25 |
| 600 | 10.75 |
| 500 | 7.75 |
| 400 | 5.25 |
| 300 | 3.00 |
| 200 | 0.00 |

200

Fig. 2
(prior art)

Side View

Top Down View

Back View

Front View

APPARATUS TO INTEGRATE BALLISTICS INFORMATION WITH A RIFLE

FIELD ON INVENTION

The field of invention pertains to the mechanical and/or electrical arts generally, and, more specifically, to an apparatus to integrate ballistics information with a rifle.

BACKGROUND

Hunters and other sportsmen are constantly seeking ways to improve the accuracy of their shot including improving the process by which they aim and fire their respective rifles.

FIGURES

A better understanding of the present invention can be obtained from the following detailed description in conjunction with the following drawings, in which:

FIG. 2 shows ballistics information in tabular form;

Figure 4:
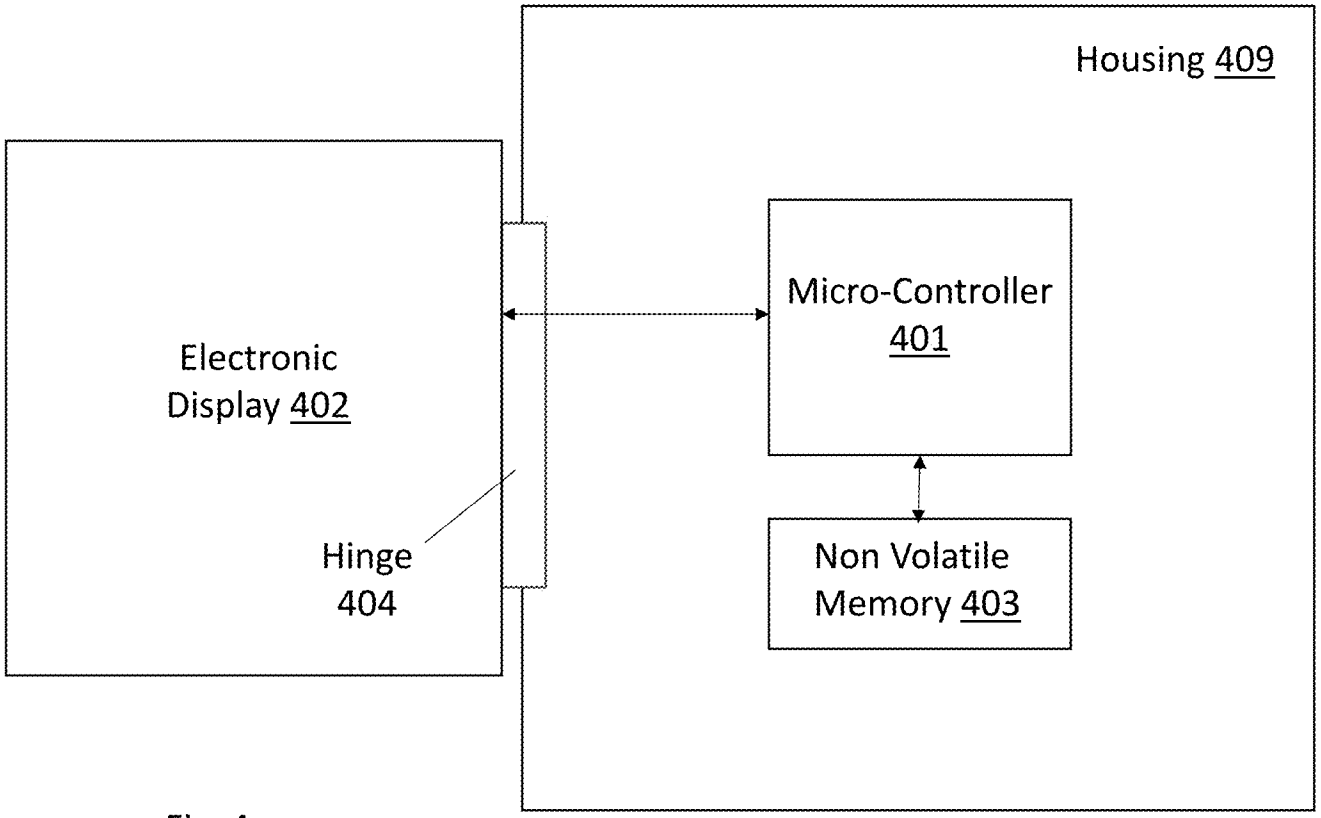

FIG. 3*a* through 3*e* shows a first embodiment of an apparatus that integrates ballistics information with a rifle scope;

FIG. 4 shows a second embodiment of an apparatus that integrates ballistics information with a rifle scope.

DETAILED DESCRIPTION

Figure 1:
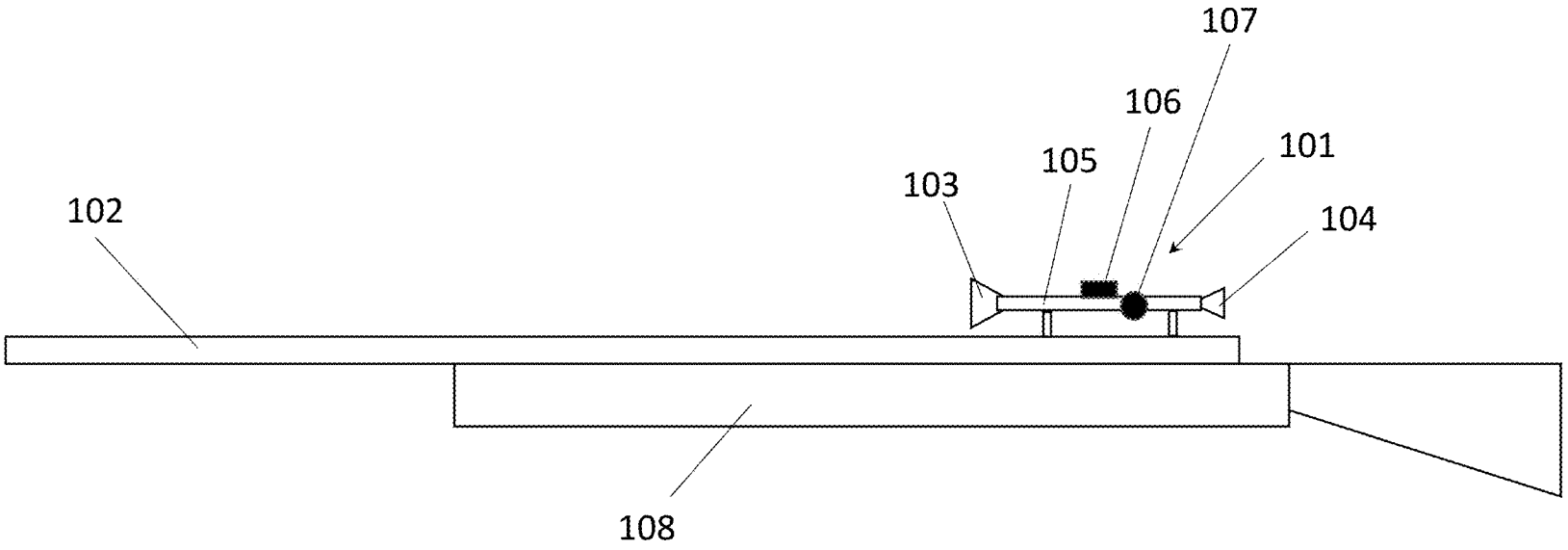
Fig. 1 (prior art)
FIG. 1 depicts a traditional prior art scope.
Figure 3A:
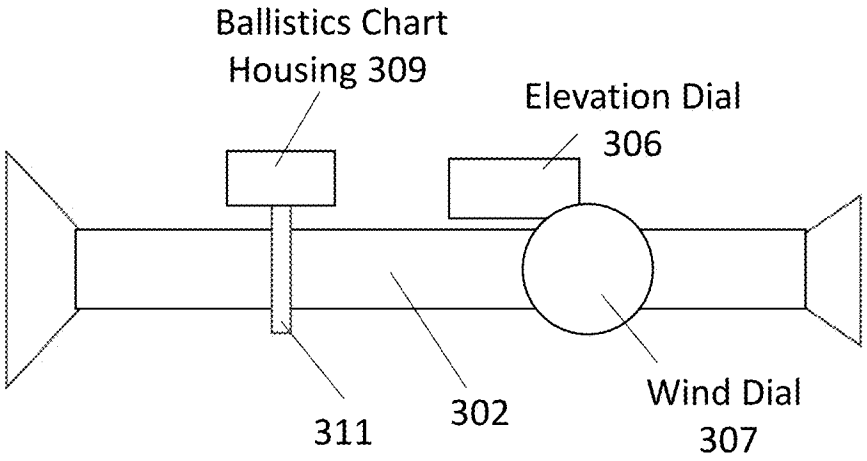
Figure 3B:
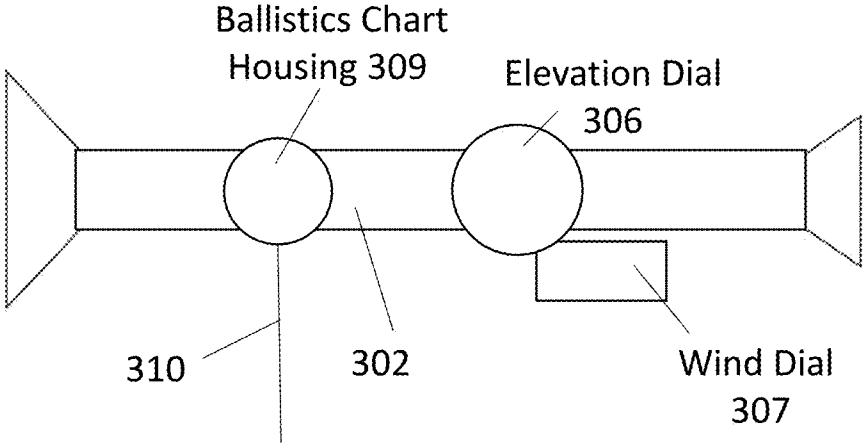
Figure 3C:
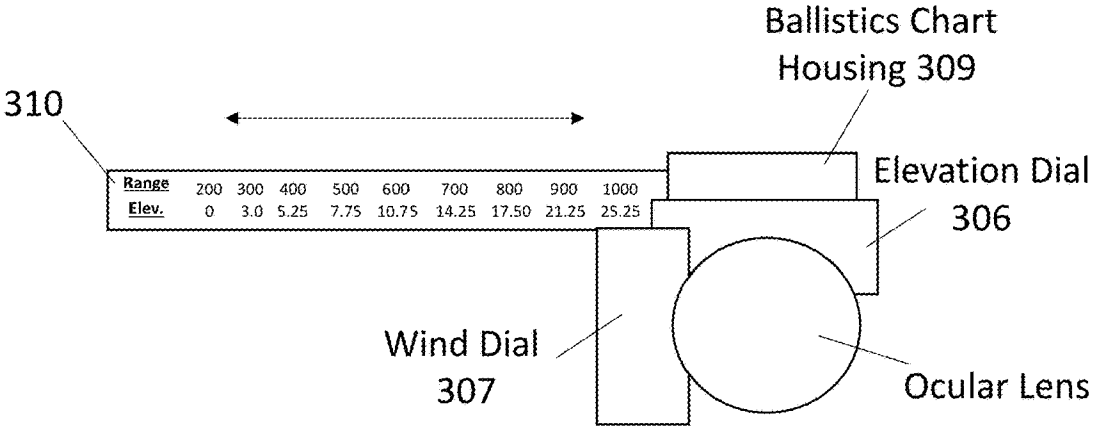
Figure 3D:
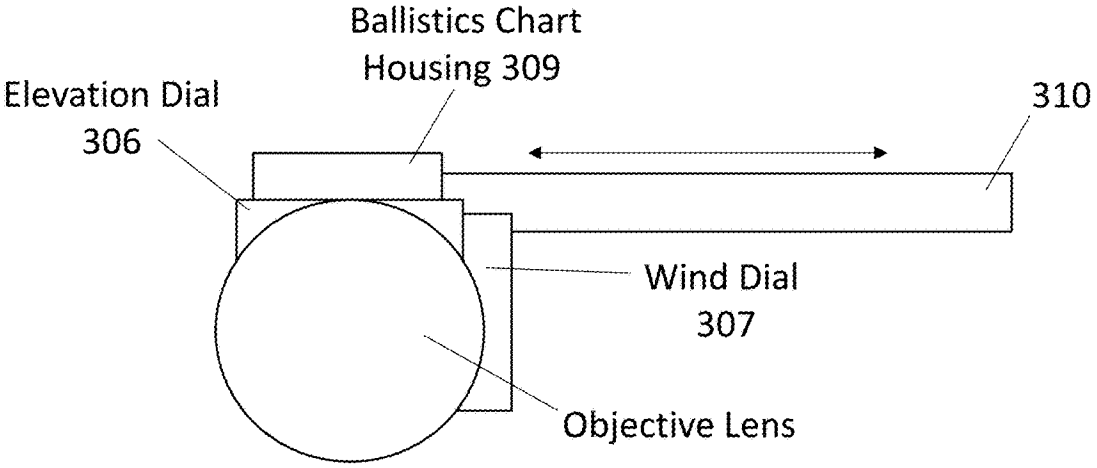
Figure 3E:
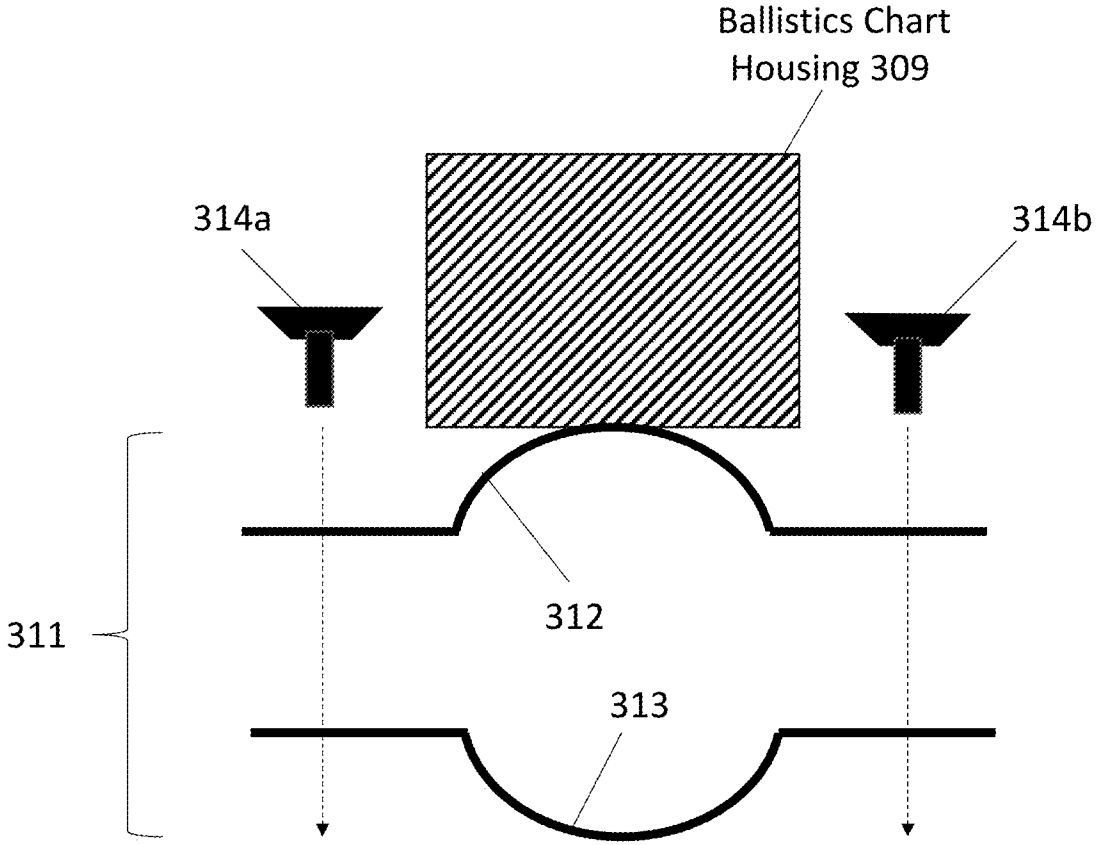

FIG. 1 depicts a traditional rifle scope 101 mounted to a rifle barrel 102. As observed in FIG. 1, the mounted scope includes an objective lens 103 that faces the target and an ocular lens 104 that faces the shooter. The objective lens 103 and ocular lens 104 are mechanically coupled by a main body tube 105. Typically, one or more magnification lenses (not shown) are situated within the main body tube or elsewhere within the scope. A magnification dial (not shown), when rotated, adjusts the position of the magnification lens(es) within the scope.

The scope also includes a pair of dials or turrets 106, 107 fixed to the main body tube 105. A first of these dials 106 (typically on the top of the scope) is used to adjust the vertical angle at which the rifle is pointed. A second dial 107 (typically on the side of the scope) is used to adjust the horizontal or lateral angle at which the rifle is pointed.

A rifle's vertical angle is adjusted to compensate for the rifle's distance to the target ("range") and the fact that gravity will cause a bullet that is fired from the rifle to accelerate toward the ground after it is fired. As such, the farther the range between the target and the rifle, the more the rifle barrel needs to pointed upward to compensate for gravity's pull on the bullet in flight.

The first dial 106, referred to as an elevation dial 106, when turned for increased range, causes the reticle inside the scope to be tipped downward, effectively moving the barrel above the point of aim as seen through the scope. When the shooter has the target focused through the scope 101, the barrel 102 will be pointed upward (will be elevated) relative to the pointing of the scope 101. With the barrel 102 pointed upward an amount that is correctly adjusted (via the elevation dial 106) for the range to the target, the bullet's flight will trace the correct arc to hit the target. That is, the bullet will at first travel upward in accordance with the barrel's angle relative to the target as determined by the elevation dial 106 setting, reach an apex, and then descend to the target.

Here, the precise setting of the elevation dial 106 involves a detailed understanding of the ballistics associated with the bullet's flight. That is, to determine the correct upward angle at which the rifle barrel 102 should be pointed for a particular range, generally, the bullet's mass and the bullet's escape velocity from the barrel 102 must be known. These values are then inserted into a mathematical relationship that generates the correct angle (or dial setting) for a specific range.

Because the individual calculations can be cumbersome to manipulate by hand, hunters or other shooters typically carry a "ballistics card". A ballistics card 200, depicted in FIG. 2, is typically implemented as a chart or table of correct elevation dial settings for specific ranges. A standard ballistics card chart or table defines elevation dial settings in units of "minute-of-angle" (MOA), milliradian, inches, or other unit of measure. As can be seen on the exemplary ballistics chart 200 of FIG. 2, if the target is 500 yards away, the correct elevation dial setting is 7.75 MOA. By contrast, if the target is 1,000 yards away, the correct elevation dial setting is 25.25. Thus, MOA settings tend to increase, reflecting higher elevation angle of the rifle as the distance to the target increases.

Referring back to FIG. 1, the second scope dial 107, referred to as wind dial, is used to set the lateral angle of the rifle barrel's pointing. The wind dial 107 helps the shooter adjust the pointing of the rifle barrel 102 in the presence of cross winds between the rifle and the target. Here, for instance, if there is a strong right to left wind blowing between the rifle and the target from the perspective of the shooter, the bullet will drift to the left after it is shot from the barrel.

In this case, the wind dial 107 would be set to deliberately point the rifle barrel to the right to compensate for this drift. That is, the turning of the dial 107 causes the reticle inside the scope to be tilted to the side, when the shooter has the target positioned in the scope's crosshairs, the pointing of the rifle barrel 102 has a right-ward offset relative to that of the image observed through the scope ("scope picture"). With the rifle barrel's right-ward offset, the bullet will be shot toward the right at the correct angle so that the bullet will drift into the target on account of the wind.

Ballistics charts can also therefore include correct wind dial settings based on winds that exist between the rifle barrel and the target. Dial settings for right to left winds cause the barrel's pointing to rotate increasingly toward the right relative to the scope picture with increasing wind speed. By contrast, dial settings for left to right winds cause the barrel's pointing to rotate increasingly toward the left relative to the scope picture with increasing wind speed.

A problem with ballistics charts is that they are cumbersome to use. When a shooter is in position to shoot, one hand is on the stock with the trigger finger just off the trigger, and, the other hand is on the forestock 108 where it can adjust the elevation and wind dials 106, 107 as needed. The shooter then aims through the scope and pulls the trigger. Ideally the rifle is hardly moved, if at all, from the time the dial setting process begins to the time the trigger is pulled.

Unfortunately, if a ballistics card is taped to the rifle, tied to the rifle with a string, or in the shooter's pocket, the shooter has to substantially move one of his/her hands to fetch the ballistic card to determine the appropriate dial setting(s). The substantial hand movements occur twice when both dials need to be set (the shooter substantially moves a hand to fetch the ballistics card, make a first reading and subsequently set a first dial, then, again substantially move the hand to again fetch the ballistics card, make a second reading and subsequently set a second dial). These substantial hand movements essentially lengthen the amount of time consumed focusing the scope on the target, and or otherwise cause the shooter's focusing routine to be cumbersome, which, in turn, results in an increased probability of a missed shot—particularly if the target is moving or capable of sudden movement.

A solution is to mechanically integrate a ballistics chart, or at least the information of a ballistics chart, into the scope itself. By mechanically integrating a ballistics chart's information on the scope, particularly if integrated near the scope's dials, the shooter's hand movements are substantially reduced during the chart reading and dial setting processes of the aiming routine.

FIGS. 3*a* through 3*e* therefore depict a first embodiment in which a mechanical scroll 310 apparatus 309 is affixed to the main body tube 302 of the scope. As can be seen in FIGS. 3*a* through 3*e*, the mechanical scroll apparatus includes a housing 309 that contains a scrolled tape 310 with ballistic chart printings thereon. When the shooter desires to make a ballistics chart reading, the shooter simply pulls on the tape 310 to extend it outward from the housing 309. Within the housing 309, the tape 310 is nominally coiled. As the shooter pulls the tape away from the housing 309 the tape 310 rotates and unwinds.

After the shooter makes a reading from the tape 310, the shooter lets go of the tape 310 and it rotates in an opposite direction as it re-coils within the housing 309. The shooter then makes a setting on the dials that the reading pertained to. Here, the printings on the tape can include both elevation dial settings for specific target ranges and wind dial settings for specific wind velocities and directions (for ease of drawing FIG. 3*b* only shows range ballistics information). The shooter should be able to effect both dial settings after one glance of the tape. The information on the tape is not limited to elevation and windage settings. For example, a shooter may wish to record the effect of temperature or elevation (above sea level) on their rifle's load. Such information could impose additional adjustments to be made to "standard" elevation and/or windage dial settings presented on the tape as described above.

As observed in FIGS. 3*a* through 3*e*, the scroll housing is mechanically coupled to a clamp 311 that rigidly fixes the scroll housing 309 to the main body tube of the scope. In the particular example of FIGS. 3*a* through 3*d*, the clamp 311 is fixed to the scope's main body tube 302 ahead of the elevation and wind dials 306, 307 (from the perspective of the shooter). As such, when the shooter is in the process of aiming the rifle towards a target, the shooter simply moves his/her non-trigger hand from, e.g., the rifle's fore-stock to the ballistic tape, pulls the tape 310 to make a reading, and then makes another brief hand movement to the particular dial that the reading was made for. Alternate configurations may choose to clamp the 309 housing farther down the scope, in front of the dials 306, 307.

In various embodiments, the housing 309 internally includes a flat spiral spring that is mechanically coupled to the tape and unwinds as the tape is pulled which increases tension in the spring. When the tape is let go of from an extended position, the spring relaxes the tension by winding itself back into a spiral. With the tape being coupled to the spring, the tape also is wound into a spiral. In various embodiments the housing 309 is weatherproofed (e.g., is hermetically sealed) so that moisture and/or other ambient conditions do not affect the operation of the tape and spring assembly.

In various embodiments the clamp 311 is designed to clamp to scopes of any of a number of different inner body tube 302 radii such as 1 inch, 30 mm, 34 mm and 35 mm. For instance, as observed in FIG. 3*e*, the clamp 311 is composed of an upper open ring 312 that is mechanically integrated with the bottom of the housing 309 and a lower open ring 313. Both rings have pairs of flanges with threaded through holes in each flange. The through holes of upper and lower flanges that face one another are aligned A screw or bolt 314*a*, 314*b* is then threaded into each through hold and tightened to clamp the housing 309 to the inner body tube.

FIG. 4 shows another embodiment in which the housing 409, instead of having a mechanical tape and spring assembly, instead includes a processor (such as a micro-controller semiconductor chip 401 or other program code execution circuit (e.g., embedded processor, multi-core processor, etc.)) and electronic touch-display 402. The firmware program code executed by the micro-controller 401 oversees look-ups into an electronic instantiation of the ballistics chart information and electronically presents the correct chart reading on the display 402 in response to earlier touches on the display by the shooter that specify the input information for the look-up (e.g., range, wind velocity and direction, etc.). As observed in FIG. 4, the display 402 can be hinge 404 mounted to the housing 409 so that it behaves like a flap that is opened when the shooter is making a ballistics chart reading and closed against the housing 409 otherwise.

The ballistics chart information can be kept on the micro-controller die 401 if the micro-controller die 401 has on board non volatile memory with sufficient space to keep all the chart information, or, off die on a non volatile memory chip 403 such as a flash memory chip. Notably, ballistics charts for many different combinations of rifle types and bullet types can be stored in the non volatile memory 403. During a reading, the micro-controller 401 refers to a sub-section of chart information within the non volatile memory 403 that is particular to the particular type of rifle that the micro-controller's housing is clamped to and/or the particular type of bullet that is to be fired from the rifle.

Here, the micro-controller's execution of the firmware program code can also present on the display 402 menu options or other touch input mechanisms to input the rifle and bullet types. Entry of this input data causes the firmware program code to refer to a particular section of the stored ballistics information when generating correct dial settings for particular input ranges and wind conditions. The input ranges and wind conditions can also be presented to the shooter on the display 402 as menu choices, or, the shooter can touch the screen to enter a specific range or wind condition.

In various embodiments, rather than implement the ballistics information as an electronic table or chart, the correct dial settings are determined by explicit calculation of the physics of a bullet's flight by the micro-controller's firmware program code. Here, for instance, a standard equation may be recorded in firmware program code with the particular rifle type and/or bullet type thereby establishing specific coefficients to be integrated within the formula(s) used in the program code's explicit calculations. Thus, rather than record entire tables/charts, instead, the non volatile memory 403 records coefficients to be used in the calculations for particular rifle and/or bullet types. When the shooter enters the specific applicable rifle and/or bullet type, the firmware program code integrates the subset of the coefficient information for the particular rifle and/or bullet from the non volatile memory into its calculation routine.

The calculation routine, when executed by the firmware program code, provides dial settings based on, e.g., range or wind input information and the proper integrated coefficients.

In various embodiments, the housing 409 also includes a re-chargeable battery that powers the micro-controller 401, the display 403 and any other electronics (e.g., a non volatile memory chip 403). In various embodiments, the housing 409 also includes volatile random access memory that the micro-controller 401 executes the firmware out of. After a power on reset, the firmware program code is loaded into the volatile random access memory from the non volatile memory 403. In yet other embodiments the micro-controller 401 executes the firmware directly out of the non volatile memory 403.

In yet another embodiment a point-to-point link electronic interface is integrated into the housing 409 with the idea that the housing electronics can wirelessly "pair" with another device (e.g., the shooter's smartphone) having the appropriate processing and memory resources to look-up and/or calculate the correct ballistics information. For example, the housing electronics may include a Bluetooth interface to pair with the shooter's smartphone through the smartphone's Bluetooth interface.

Here, in the case of an elevation setting, the shooter enters an estimated range through the electronic display 402. The housing electronics then transmits the estimated range through the Bluetooth interface to the smartphone. An application executing on a processor of the smartphone determines the correct elevation dial setting (e.g., through a look-up or explicit calculation as described above) and then transmits the dial setting to the housing electronics through the Bluetooth link (the application can be stored on non volatile memory of the smartphone). The housing electronics then presents the dial setting on the electronic display 402. A similar procedure can take place for wind dial settings. Note that if the smart phone undertakes a look-up procedure to determine a correct dial setting, conceivably the ballistics information can be kept "in the cloud" on a remote server that the smartphone accesses through its cellular wireless network interface. Regardless, with the communicative pairing described above, embodiments could include a smartphone application designed to operate in accordance with the smartphone operations described above.

Although embodiments above have described the ballistics information as being mechanically integrated, in some fashion, to the scope, in yet other embodiments the housing could be clamped directly to the rifle (such as to the rifle barrel or a picatinny type rail on the rifle's forestock) or even the rifle and scope. As such, the clamp mechanism could be designed to clamp to a scope feature, a rifle feature and/or respective features of both a scope and rifle.

Embodiments of the invention may include various processes as set forth above. The processes may be embodied in machine-executable instructions. The instructions can be used to cause a general-purpose or special-purpose processor (e.g., micro-controller) to perform certain processes. Alternatively, these processes may be performed by specific/custom hardware components that contain hardwired logic circuitry or programmable logic circuitry (e.g., FPGA, PLD) for performing the processes, or by any combination of programmed computer components and custom hardware components.

Elements of the present invention may also be provided as a machine-readable medium for storing the machine-executable instructions. The machine-readable medium may include, but is not limited to, floppy diskettes, optical disks, CD-ROMs, and magneto-optical disks, FLASH memory, ROMs, RAMs, EPROMs, EEPROMs, magnetic or optical cards, propagation media or other type of media/machine-readable medium suitable for storing electronic instructions. For example, the present invention may be downloaded as a computer program which may be transferred from a remote computer (e.g., a server) to a requesting computer (e.g., a client) by way of data signals embodied in a carrier wave or other propagation medium via a communication link (e.g., a modem or network connection).

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

The invention claimed is:

1. An apparatus, comprising:

a clamp element to clamp to a rifle and/or scope;

a housing, the housing mechanically coupled to the clamp element, the housing containing recorded ballistics information;

wherein the housing includes circuitry to transmit any of the following to an electronic device that is communicatively paired with the housing:

a range;

a wind's direction and/or speed.

2. The apparatus of claim 1 wherein the recorded ballistics information is electronically recorded on non volatile memory within the housing.

3. The apparatus of claim 2 wherein an electronic display is mechanically integrated with the housing.

4. The apparatus of claim 2 wherein the non volatile memory also stores program code that when executed by a micro-controller within the housing causes the micro-controller to perform a method, the method comprising:

accepting rifle type and/or bullet type information; and, configuring the program code to base elevation and/or wind dial settings from a subset of the recorded ballistics information that is specific to the rifle type and/or bullet type information.

5. The apparatus of claim 4 wherein the method further comprises presenting on an electronic display that is mechanically integrated with the housing a visual mechanism for entering any of:

range;

wind direction;

wind velocity.

6. The apparatus of claim 2 further wherein the non volatile memory is implemented with flash memory.

7. The apparatus of claim 1 wherein the ballistics information is recorded in tabular form.

8. The apparatus of claim 1 wherein the circuitry is to receive the following from the electronic device:

an elevation dial setting in response to the circuitry's transmitting of the range;

a wind dial setting in response to the circuitry's transmitting of the wind's direction and/or speed.

9. A non-transitory machine readable storage medium containing program code that when processed by a processor of an electronic device causes the electronic device to perform a method, the method comprising:

receiving a range from a second electronic device that is mechanically coupled to a scoped rifle;

determining an appropriate elevation dial setting for the range;

sending the appropriate elevation dial setting to the second electronic device.

10. The non-transitory machine readable storage medium of claim 9 wherein the method further comprises:

receiving a wind's speed and/or direction from the second electronic device;

determining an appropriate wind dial setting for the wind's speed and/or direction;

sending the appropriate wind dial setting to the second electronic device.

11. A non-transitory machine readable storage medium containing program code that when processed by a processor of an electronic device causes the electronic device to perform a method, the method comprising:

receiving a range through an electronic display of the electronic device;

sending the range to a second electronic device that is paired with the electronic device;

receiving an appropriate elevation dial setting from the second electronic device;

displaying the appropriate elevation dial setting on the electronic display.

12. The non-transitory machine readable storage medium of claim 9 wherein the method further comprises:

receiving a wind's speed and/or direction through the electronic display;

sending the wind's speed and/or direction to the second electronic device;

receiving an appropriate wind dial setting from the second electronic device;

displaying the appropriate wind dial setting on the electronic display.

* * * * *